United States Patent [19]

Ruseff et al.

[11] Patent Number: 4,553,904

[45] Date of Patent: Nov. 19, 1985

[54] PUMP CONTROL WITH FLUID RESPONSIVE STANDBY PRESSURE

[75] Inventors: Walter Z. Ruseff, New Lenox; James E. Schimpf, Joliet, both of Ill.

[73] Assignee: Caterpillar Tractor Co., Peoria, Ill.

[21] Appl. No.: 655,289

[22] PCT Filed: Dec. 21, 1981

[86] PCT No.: PCT/US81/01715

§ 371 Date: Dec. 21, 1981

§ 102(e) Date: Dec. 21, 1981

[87] PCT Pub. No.: WO83/02304

PCT Pub. Date: Jul. 7, 1983

[51] Int. Cl.[4] ..... F04B 1/26

[52] U.S. Cl. ..... 417/218; 60/452; 417/222

[58] Field of Search ..... 407/218, 222; 60/445, 60/450, 452; 137/596.13; 91/451

[56] References Cited

U.S. PATENT DOCUMENTS

| | | | |
|---|---|---|---|
| 3,350,881 | 11/1967 | D'Amato | 60/52 |
| 3,406,850 | 10/1968 | Hancox | 214/138 |
| 4,074,529 | 2/1978 | Budzich | 60/445 |
| 4,124,333 | 11/1978 | Liesener | 417/218 |
| 4,330,991 | 5/1982 | Budzich | 137/596.13 |
| 4,420,935 | 12/1983 | Kobald | 60/452 X |

*Primary Examiner*—Edward K. Look

*Attorney, Agent, or Firm*—J. W. Burrows

[57] ABSTRACT

A pump control assembly (16) controls the displacement of a pump (11) and provides a standby pressure (87) that is greater than the difference (96) between the load pressure and the pump discharge pressure. A valve mechanism (38) provides a predetermined pressure signal to a valve member (23) for adding a force to the valve member to provide a control signal to an actuating member (17) which adjusts the pump's flow and pressure to a standby condition. The pump control assembly provides a more precise control of the standby position while eliminating large, bulky springs.

11 Claims, 2 Drawing Figures

PUMP CONTROL WITH FLUID RESPONSIVE STANDBY PRESSURE

DESCRIPTION

1. Technical Field

This invention is directed to a pump control for a variable displacement pump and more particularly to a mechanism for maintaining a standby pressure that is responsive to fluid pressure and greater than the difference between the load and discharge pressures.

2. Background Art

In many pump controls known today, a standby pressure is achieved by providing a spring having the needed force to move a control member for directing a control signal to an actuating member of the pump to increase the output of the pump in proportion to the force of the spring. The spring must have a length of compression to accommodate the full range of load pressures. The required force capacity and length of compression of the spring makes the spring bulky consequently, requiring a large space for the total pump control. The large, bulky spring has a tendency to fail or lose its force capacity due to its length of compression.

The present invention is directed to overcoming one or more of the problems as set forth above.

DISCLOSURE OF THE INVENTION

In one aspect of the invention, a pump control assembly for changing the displacement of a variable displacement pump has an actuating mechanism to change the pump's displacement and a valve member having first and second ends. The valve member is movable between a first position, an infinitely variable intermediate position and a second position. At the first position, a pump discharge pressure is in communication with the actuating mechanism while at the intermediate position, the pump discharge pressure is controllably modulated to deliver a control signal to the actuating member. At the second position, the pump discharge is blocked from communication with the actuating mechanism and the actuating mechanism is in communication with a tank. The first end of the valve member is in continuous fluid communication with the pump discharge pressure for biasing the valve member toward one of the first and second positions. A signal representative of a load from a control valve in an actuated position communicates with the second end of the valve member for biasing the valve member toward the other of the first and second positions in conjunction with a spring. At the intermediate position, the valve member controllably delivers the control pressure to the actuating mechanism to maintain a constant differential pressure between the discharge pressure and the load pressure. A means is provided for controllably delivering a predetermined pressure signal to the second end of the valve member in response to the load signal being below the predetermined pressure signal so that the valve member controllably delivers a predetermined control pressure to the actuating mechanism.

This invention solves the problems encountered with using a large spring in a pump control to obtain a standby pressure greater than the difference in pressure between the load and discharge pressures. The mechanism of this invention replaces the large spring with a second valve member that provides a predetermined pressure which acts on one end of the first valve member in conjunction with a small spring to provide the needed force for the desired standby pressure. The components of the second valve are small and require limited movement which adds reliability to the pump control.

BEST MODE FOR CARRYING OUT THE INVENTION

Figures 1, 2:
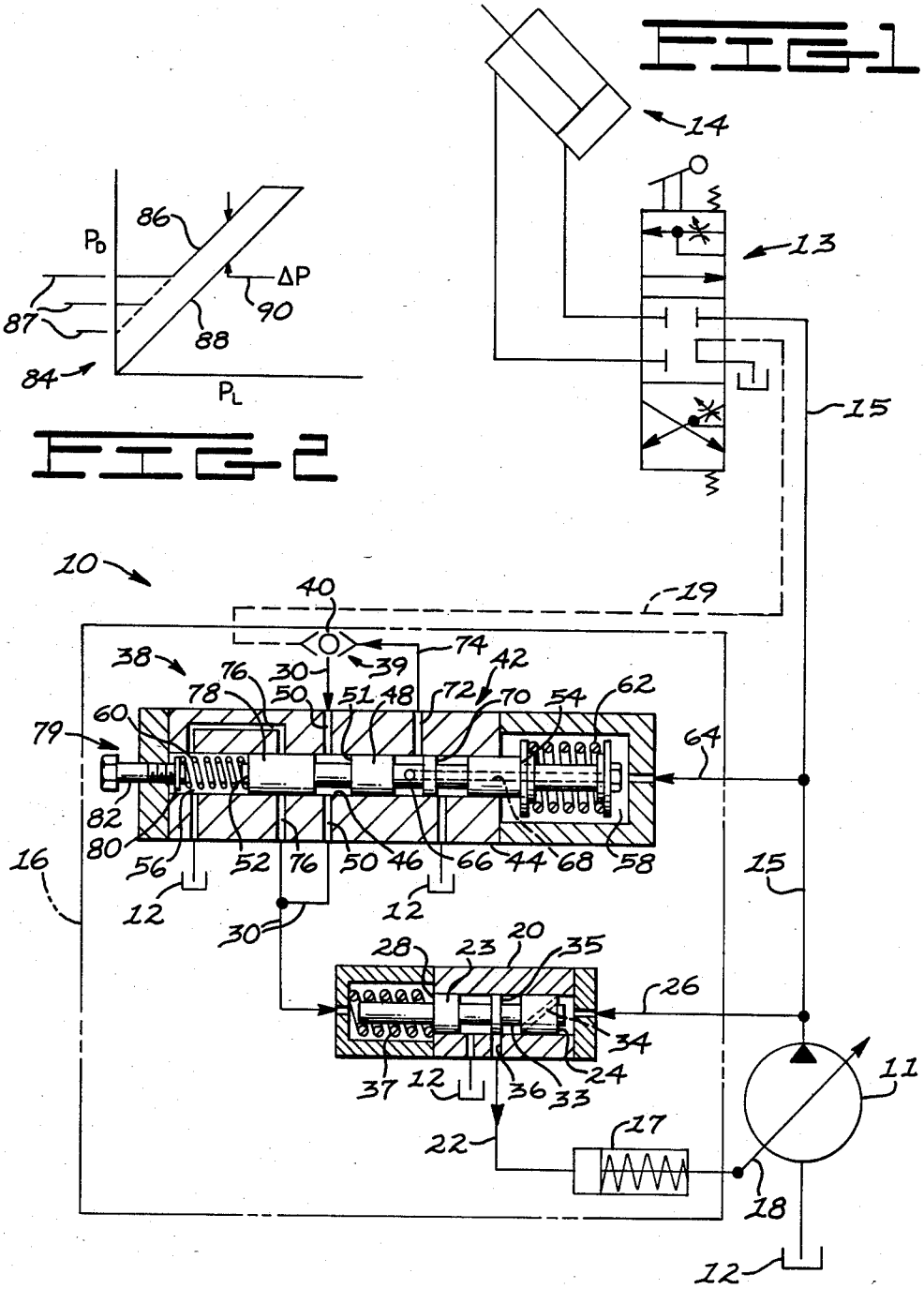
FIG. 1 is a partial schematic and diagrammatic representation of an embodiment of the present invention.
FIG. 2 is a graphical illustration of a pump discharge pressure verses load pressure characteristics of the variable displacement pump utilizing the subject invention.

Referring now to FIG. 1, a fluid system is generally indicated by reference numeral 10. The fluid system 10 includes a variable displacement pump 11 connected to a tank or reservoir 12 and a control valve 13 and a cylinder 14 respectively connected to the pump 11 by a conduit 15.

The fluid system 10 further includes a pump control assembly 16 mounted to the pump 11. An actuating means 17 is connected to a displacement changing member 18, such as a swashplate, not shown, for changing the flow rate from the pump 11. A conduit 19 directs a signal representative of the load from the cylinder 14 to the pump control assembly 16 in a conventional manner when the control valve 13 is in an operational position.

A first valve 20 is connected to the actuating means 17 by a conduit 22. The first valve 20 includes a valve member, such as a spool 23, having a first end 24 which communicates with the pump discharge pressure through a conduit 26 while a second end 28 connects to a conduit 30. The spool 23 is slideably disposed in the first valve 20 and is movable between first, infinitely variable intermediate and second positions. The pump discharge pressure communicates with an annulus 33 of the spool 23 through a passage 34 and a land 35 of the spool 23 in conjunction with a passage 36 of the valve 20 and thus controllably modulates the pump discharge pressure to the passage 36 to communicate a control signal to the actuating means 17 through the conduit 22. A spring 37 engages the second end 28 of the spool 23 and biases the spool 23 towards the first position.

A means 38 is provided for controllably delivering a predetermined pressure signal to the second end 28 of the spool 23 through the conduit 30. The means 38 includes a means 39, such as a resolver valve 40, for selecting the larger of the load signal and the predetermined pressure signal and communicating the larger signal to the second end of the spool 23 through conduit 30 while blocking the other signal.

The means 38 further includes a second valve 42 located in the conduit 30. The second valve 42 has a housing 44 defining a bore 46 and a spool 48 slideably disposed in the bore 46. The spool 48 moves between first, second and third positions. A passage 50 through the housing 44 intersects the bore 46 and interconnects the conduit 30 while a land 51 on spool 48 selectively blocks the passage 50. The spool 48 has first and second ends 52,54 and first and second chambers 56,58 are defined in the bore 46 at opposite ends of the spool 48. A first spring 60 is located in the first chamber 56 and abuts the first end 52 of the spool 48 to bias the spool 48 towards the first position. A second spring 62 is mounted on the second end 54 of the spool 48 to oppose movement of the spool 48 from the second to the third position. A conduit 64 communicates the second chamber 58 with the pump discharge pressure.

The pump discharge pressure is communicated from the second chamber 58 of the valve member 42 to an annulus 66 of the spool 48 through a passage 68. A land 70 on spool 48 and a passage 72 in the housing 44 controllably modulates the pump discharge pressure to produce the predetermined pressure signal in response to spool movement in the first position. A conduit 74 communicates the predetermined pressure signal from the passage 72 to the resolver valve 40. If the load signal is lower than the predetermined pressure signal, the resolver valve 40 blocks the conduit 19 and directs the predetermined pressure to the conduit 30.

A passage 76 in housing 44 intersects the bore 46 and connects at one end to the conduit 30 between the second valve 42 and the first valve 20 and at the other end to the tank 12. A land 78 on spool 48 selectively opens the passage 76.

A means 79 is provided for adjusting the force on the spring 60 and includes a spring support 80 located in the first chamber 56 and in contact with one end of the spring 60. A threaded member 82 is threadably secured in the housing 44 and contacts the spring support 80.

Referring now to FIG. 2, a graphic diagram is generally indicated by reference number 84. A line 86 represents a range of pump discharge pressures ($P_D$) having a variable minimum standby pressure as indicated at 87. A line 88 represents a range of load pressures ($P_L$) and a difference in pressure ($\Delta P$) between the pump discharge and the load pressure is indicated on the graph by reference number 90.

Industrial Applicability

The present invention has particular utility in pump control systems requiring less space, more dependability and a variable standby pressure that is higher than the differential pressure between the load and pump discharge pressures.

Upon start up, the pump 11 produces flow to the control valve 13 from the tank 12 through conduit 15. With the valve 13 in the center position as shown, the flow from the pump 11 is blocked and the pump discharge pressure increases. The pump discharge pressure is simultaneously communicated with the first end 24 of spool 23 and to the second chamber 58 of the second valve 42.

The pump discharge pressure communicates with the annulus 66 of the spool 48 through passage 68 while the discharge pressure simultaneously acts on the second end 54 of the spool 48 moving the spool 48 from the first position towards the second position against the bias of the spring 60. The spool 48 moves to the second position in response to the pump discharge pressure exceeding a first pressure level. The land 70 in cooperation with passage 72 controllably modulates the discharge pressure in response to the movement of spool 48 to produce the predetermined pressure signal in the passage 72 proportional to the force bias of the spring 60.

The first position of the spool 48 includes a range of spool movement up to the second position. During the spool movement in the first position, the predetermined pressure signal communicates with the second end 28 of the spool 23. The added force from the predetermined pressure signal acting on the second end 28 of the spool 23 plus the force of the spring 37 moves the spool 23 toward the second position at which the actuating means 17 is in communication with the tank 12 thus causing the flow from the pump 11 to increase and the pump discharge pressure is blocked from the actuating means 17. At the same time the discharge pressure acts on the first end 24 of the spool 23 moving it towards the first position at which the pump discharge pressure communicates with the actuating means 17 to decrease the output flow from the pump 11. As a result of the opposing forces on the spool 23, it moves to the infinitely variable intermediate position at which the control signal delivered to the actuating means 17 adjusts the pump's displacement to a predetermined standby pressure as indicated at 87 in FIG. 2. As noted at 87 in FIG. 2, the standby pressure can be adjusted. This is accomplished by changing the force on spring 60 by turning the threaded member 82 of valve member 42 to increase or decrease the force on the spring 60.

Upon actuation of the valve 13, the load pressure from the cylinder 14 communicates with the conduit 19 in a conventional manner. Once the load pressure increases beyond the predetermined pressure signal, the resolver valve 40 blocks the conduit 74 and the larger load signal is communicated to the second end 28 of the spool 23. Simultaneously with an increase in load pressure, the pump discharge pressure increases beyond the first pressure level moving the spool 48 of the valve 42 to the second position, at which the predetermined pressure signal in passage 72 is blocked by the land 70 and the load signal passes through the conduit 30 and passage 50. As the load pressure increases beyond the predetermined pressure signal, a fixed differential pressure ($\Delta P$) is maintained between the load pressure ($P_L$) and the pump discharge pressure ($P_D$) as depicted at 90 on FIG. 2.

As the pump discharge pressure increases proportional to the load pressure and the pump discharge pressure acting on the second end 54 of the spool 48 increases beyond a second pressure level, the spool 48 moves towards the third position against the combined bias of the second spring 62 and the first spring 60. At the third position of the spool 48, the load signal in passage 50 is blocked by the land 51 of the spool 48 and the second end 28 of the spool 23 is communicated with the tank. The spool 48 maintains an infinitely variable intermediate position between the second and third positions at which the load signal being delivered to the second end 28 of the spool 23 is controllably modulated to a predetermined maximum pressure level. As a result of the load signal acting on the second end 28 being controlled to a maximum pressure level, the pump discharge pressure acting on the first end 24 of the spool 23 moves the spool 23 against the combined bias of the controlled load signal and the spring 37 to communicate the modulated control pressure from the pump discharge to the actuating means 17. The control pressure decreases the pump's displacement to a position of essentially no flow, but still maintaining the maximum pressure level in the system as established by the combined force of the springs 60 and 62.

With the use of this pump control assembly, a compact arrangement is achieved without requiring a large spring having a long length of compression while still maintaining a standby pressure that is greater than the difference between the load and pump discharge pressures.

Other aspects, objects and advantages of this invention can be obtained from a study of the drawings, disclosure and appended claims.

We claim:

1. In a pump control assembly (16) for changing the displacement of a variable displacement pump (11), the assembly (16) having an actuating means (17) for changing the displacement of the pump (11) and a valve member (23) having first and second ends (24,28), the valve member (23) being movable between a first position at which a pump discharge pressure is in communication with the actuating means (17), an infinitely variable intermediate position at which the pump discharge pressure is controllably modulated to deliver a control pressure to the actuating means (17) and a second position at which the pump discharge pressure is blocked from communication with the actuating means (17) and the actuating means (17) is in communication with a tank (12), the first end (24) of the valve member (23) being in continuous fluid communication with the pump discharge pressure for biasing the valve member (23) toward one of the first and second positions, a signal representative of a load being in selective fluid communication with the second end (28) for biasing the valve member (23) toward the other of the first and second positions in conjunction with a spring (37), the load signal being received from a control valve (13) being in an actuated position, said control pressure maintaining a constant differential pressure between the discharge pressure and the load pressure, the improvement comprising:

means (38) for controllably delivering a predetermined minimum pressure signal to the second end (28) of the valve member (23) in response to the load signal being below the predetermined minimum pressure signal so that the valve member (23) controllably delivers a predetermined control pressure to the actuating means (17).

2. The pump control assembly (16), as set forth in claim 1, wherein the delivery means (38) includes a means (39) for selecting the larger of the load signal and the predetermined minimum pressure signal and a conduit (30) communicating the larger signal to the second end (28) of the valve member (23).

3. The pump control assembly (16), as set forth in claim 2, wherein said delivery means (38) includes a second valve member (48) having first and second ends (52,54) and located in the conduit (30); the second valve member (48) being movable between a first position at which the larger of the load signal and the predetermined minimum pressure signal is communicated with the second end (28) of the first valve member (23); and a second position at which the load signal is communicated with the second end (28) of the first valve member (23) while the predetermined minimum pressure signal is blocked.

4. The pump control assembly (16), as set forth in claim 3, wherein the delivery means (38) includes a spring (60) biasing the second valve member (48) to the first position, the biasing force of the spring (60) establishes the level of the predetermined minimum pressure signal and the second valve member (48) is moved to the second position in response to the pump discharge pressure signal communicated with the second end (54) of the second valve member (48) increasing beyond a first pressure level.

5. The pump control assembly (16), as set forth in claim 4, wherein the second valve member (48) is movable to a third position at which the load and the predetermined minimum pressure signals are blocked from the second end (28) of the first valve member (23) while the second end (28) of the first valve member (23) is communicated with a tank (12), said second valve member maintaining an infinitely variable intermediate position between the second and third positions at which the predetermined minimum pressure signal is blocked and the load signal is controllably modulated to a predetermined pressure level in response to the pump discharge pressure signal communicated with the second end (54) of the second valve member (48) increasing beyond a second pressure level.

6. The pump control assembly (16), as set forth in claim 5, wherein the delivery means (38) includes a second spring (62) opposing the movement of the the second valve member (48) from the second position to the third position.

7. The pump control assembly (16), as set forth in claim 6, including a means (79) for adjusting the biasing force of the spring (60) which biases the second valve member (48) to the first position.

8. The pump control assembly (16), as set forth in claim 7, wherein the selecting means (39) includes a ball resolver (40) adapted to select the larger of the load signal and the predetermined minimum pressure signal and communicate the larger signal with the conduit (30).

9. The pump control assembly (16), as set forth in claim 2, wherein the delivery means (38) includes a valve (42) located in the conduit (30); said valve (42) having a housing (44) defining a bore (46), a spool (48) slideably disposed in the bore (46) and having first and second ends (52,54), first and second chambers (56,58) being defined in the bore (46) at opposite ends of the spool (48); the second chamber (58) of the bore (46) being in fluid communication with the pump discharge pressure; the spool (48) being movable between first and second positions; a first spring (60) located in the first chamber (56) biases the spool (48) to the first position while the pump discharge pressure moves the spool (48) to the second position; a passageway (50) interconnects the conduit (30) and communicates the larger of the load signal and the predetermined minimum pressure signal through the housing (44); the pump discharge pressure is controllably modulated by the spool (48) between the first and second positions to produce the predetermined minimum pressure signal; the larger of the load signal and the predetermined minimum pressure signal being communicated through the passageway (50) when the spool (48) is in the first position; and the predetermined minimum pressure signal is blocked and the load signal is communicated through the passageway (50) when the spool (48) is at the second position.

10. The pump control assembly (16), as set forth in claim 9, wherein the spool (48) of the valve (42) is movable to a third position at which the load signal and the predetermined minimum pressure signal are blocked while the second end of the valve member (23) is communicated with the tank (12), maintaining an infinitely variable intermediate position between the second and third positions at which the predetermined minimum pressure signal is blocked and the load signal is controllably modulated to a predetermined pressure level in response to the pump discharge pressure signal communicated with the second end (54) of the spool (48) increasing beyond a second pressure level, said spool (48) having a second spring (62) mounted on the second end (54) of the spool (48) and opposing movement of the spool (48) from the second position to the third position.

11. The pump control assembly (16), as set forth in claim 9, including means (79) for adjusting the force of the first spring (60) to change the predetermined minimum pressure signal.

* * * * *